US011849888B2

(12) United States Patent
Shockley

(10) Patent No.: US 11,849,888 B2
(45) Date of Patent: Dec. 26, 2023

(54) BATHROOM TISSUE HOLDER ASSEMBLY

(71) Applicant: Douglas Shockley, Marysville, CA (US)

(72) Inventor: Douglas Shockley, Marysville, CA (US)

( * ) Notice: Subject to any disclaimer, the term of this patent is extended or adjusted under 35 U.S.C. 154(b) by 239 days.

(21) Appl. No.: 17/552,441

(22) Filed: Dec. 16, 2021

(65) Prior Publication Data

US 2023/0190051 A1 Jun. 22, 2023

(51) Int. Cl.
*A47K 10/38* (2006.01)
*A47K 10/32* (2006.01)

(52) U.S. Cl.
CPC ..... *A47K 10/38* (2013.01); *A47K 2010/3253* (2013.01)

(58) Field of Classification Search
CPC ..... A47K 10/38
See application file for complete search history.

(56) References Cited

U.S. PATENT DOCUMENTS 3,168,258 A 2/1965 Schwartz
4,385,733 A 5/1983 Okeefe
5,192,044 A 3/1993 Baskin
6,945,493 B1 9/2005 Gottesman
10,426,300 B1 10/2019 Young
10,952,571 B2 3/2021 Romnosky
2007/0095769 A1 5/2007 Jenkins
2012/0118909 A1* 5/2012 Yaros ..... A47K 10/38 221/45
2012/0261436 A1* 10/2012 Farrell ..... A47K 10/3836 221/199
2014/0124525 A1* 5/2014 Delaney ..... A47K 10/38 221/34
2015/0083743 A1* 3/2015 D'Angelo ..... A47K 10/38 221/45
2020/0163499 A1 5/2020 Marcus

* cited by examiner

*Primary Examiner* — Gene O Crawford
*Assistant Examiner* — Ayodeji T Ojofeitimi

(57) ABSTRACT

A bathroom tissue holder assembly for holding a pair of rolls of toilet tissue includes a bracket that is mountable to a vertical support surface at a point located proximate a lavatory. A shaft is provided and the shaft removably engages the bracket to support a first roll of toilet tissue on the bracket. A holder is coupled to and extends upwardly from the bracket to support a second roll of toilet tissue. In this way the second roll of toilet tissue is accessible when the first roll of toilet tissue is depleted. A wrapping is formable into a cylinder and the wrapping can be wrapped around the second roll of toilet tissue when the second roll of toilet tissue is being stored on the holder.

8 Claims, 6 Drawing Sheets

BATHROOM TISSUE HOLDER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to holder devices and more particularly pertains to a new holder device for holding a pair of rolls of toilet tissue. The device includes a bracket and a shaft that engages the bracket which supports a first roll of toilet tissue on the bracket. The device includes a holder that extends upwardly from the bracket for holding a second roll of toilet tissue. The device includes a wrapper that can be wrapped around the second roll of toilet tissue for concealing the second roll of toilet tissue.

(2) Description of Related Art Including Information Disclosed Under 37 CFR 1.97 and 1.98

The prior art relates to holder devices including a toilet paper holder which includes a pair of holding areas being vertically stacked for holding a pair of rolls of toilet tissue in a vertical stack. The prior art discloses a toilet tissue holder that includes a bracket for holding a first roll of toilet tissue and a basket positioned beneath the bracket for holding a second roll of toilet tissue. The prior discloses a variety of toilet tissue holders which hold a pair of rolls of toilet tissue in a vertically stacked orientation. The prior art discloses a modular toilet tissue holder which can be assembled in a variety of configurations.

BRIEF SUMMARY OF THE INVENTION

An embodiment of the disclosure meets the needs presented above by generally comprising a bracket that is mountable to a vertical support surface at a point located proximate a lavatory. A shaft is provided and the shaft removably engages the bracket to support a first roll of toilet tissue on the bracket. A holder is coupled to and extends upwardly from the bracket to support a second roll of toilet tissue. In this way the second roll of toilet tissue is accessible when the first roll of toilet tissue is depleted. A wrapping is formable into a cylinder and the wrapping can be wrapped around the second roll of toilet tissue when the second roll of toilet tissue is being stored on the holder.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
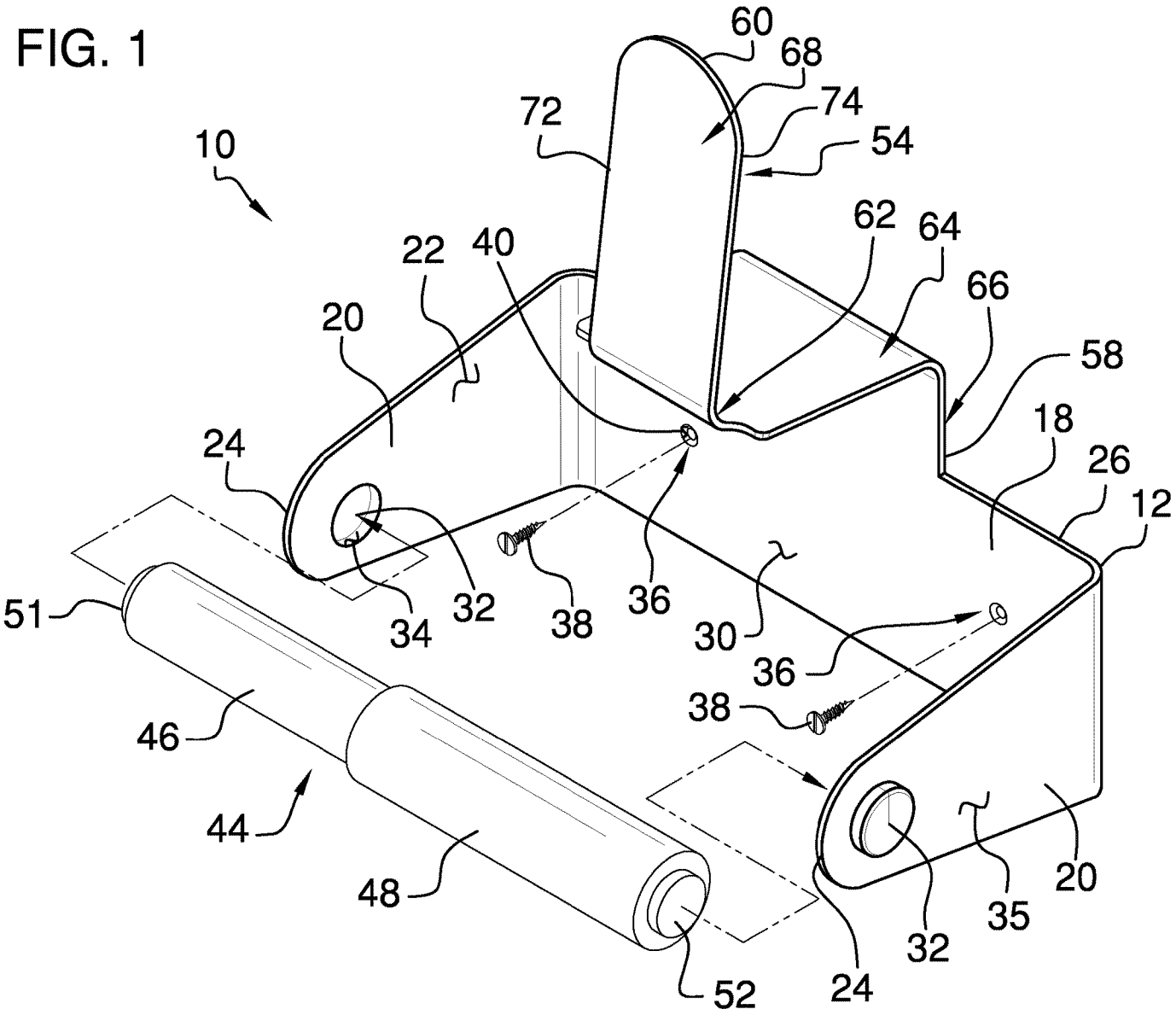
FIG. 1 is an exploded perspective view of a bathroom tissue holder assembly according to an embodiment of the disclosure.
Figure 2:
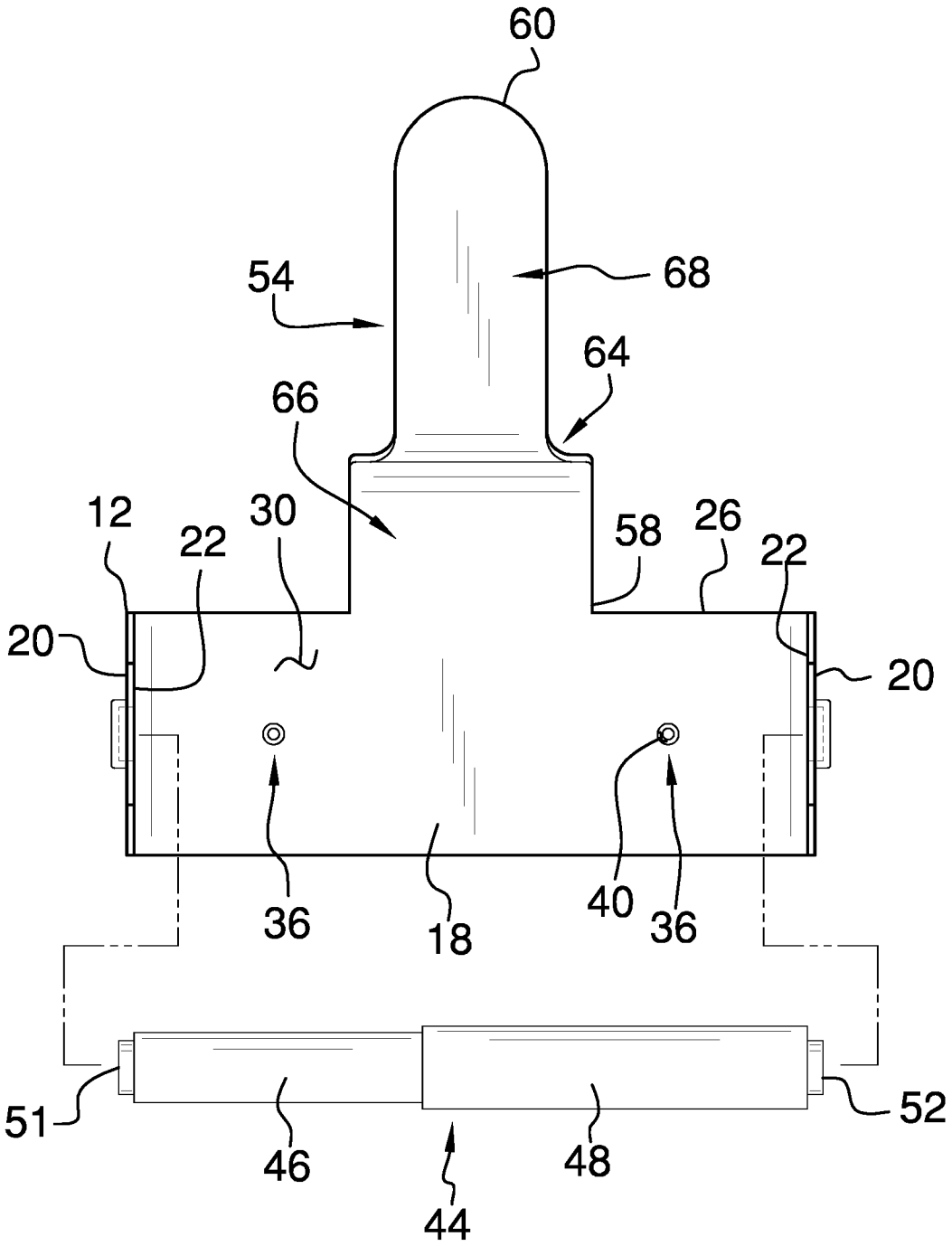
FIG. 2 is a front exploded view of an embodiment of the disclosure.
Figure 3:
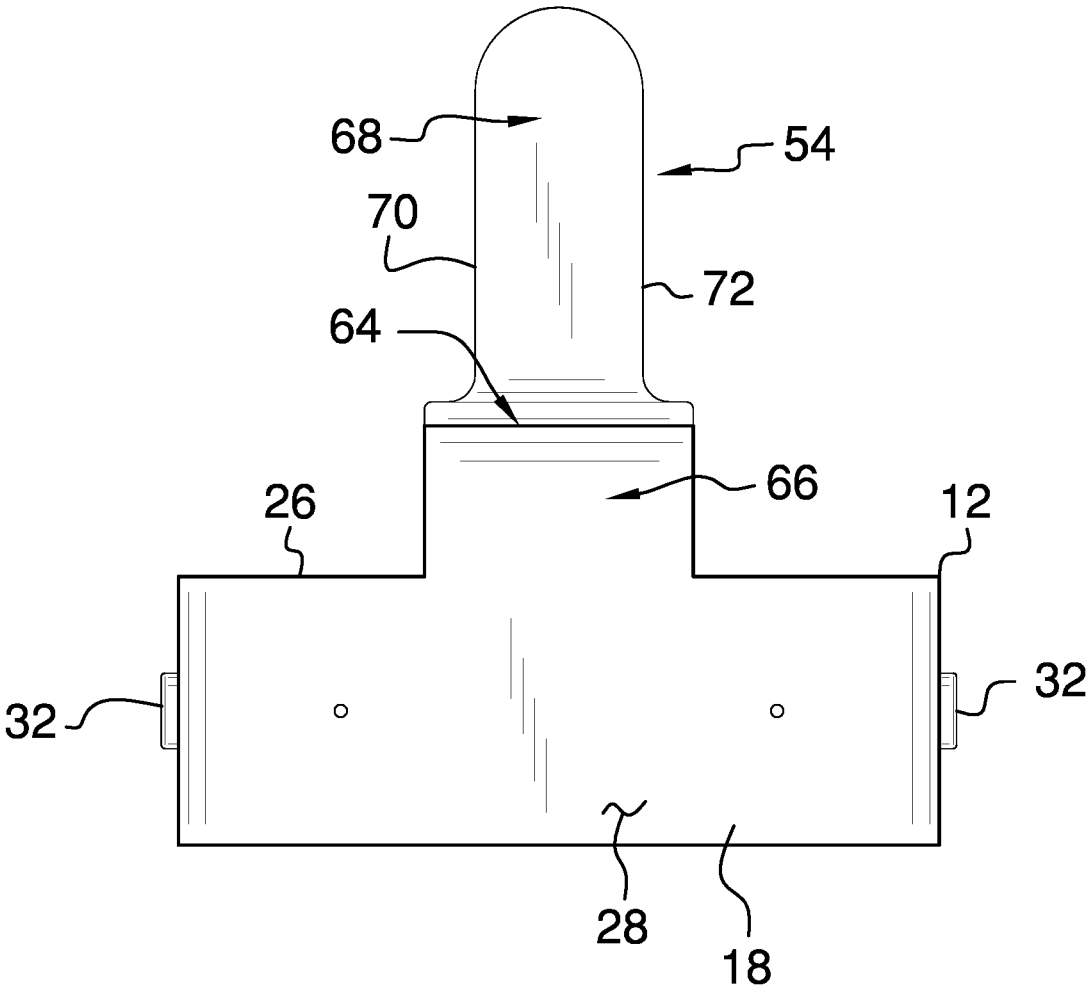
FIG. 3 is a back view of an embodiment of the disclosure.
Figure 4:
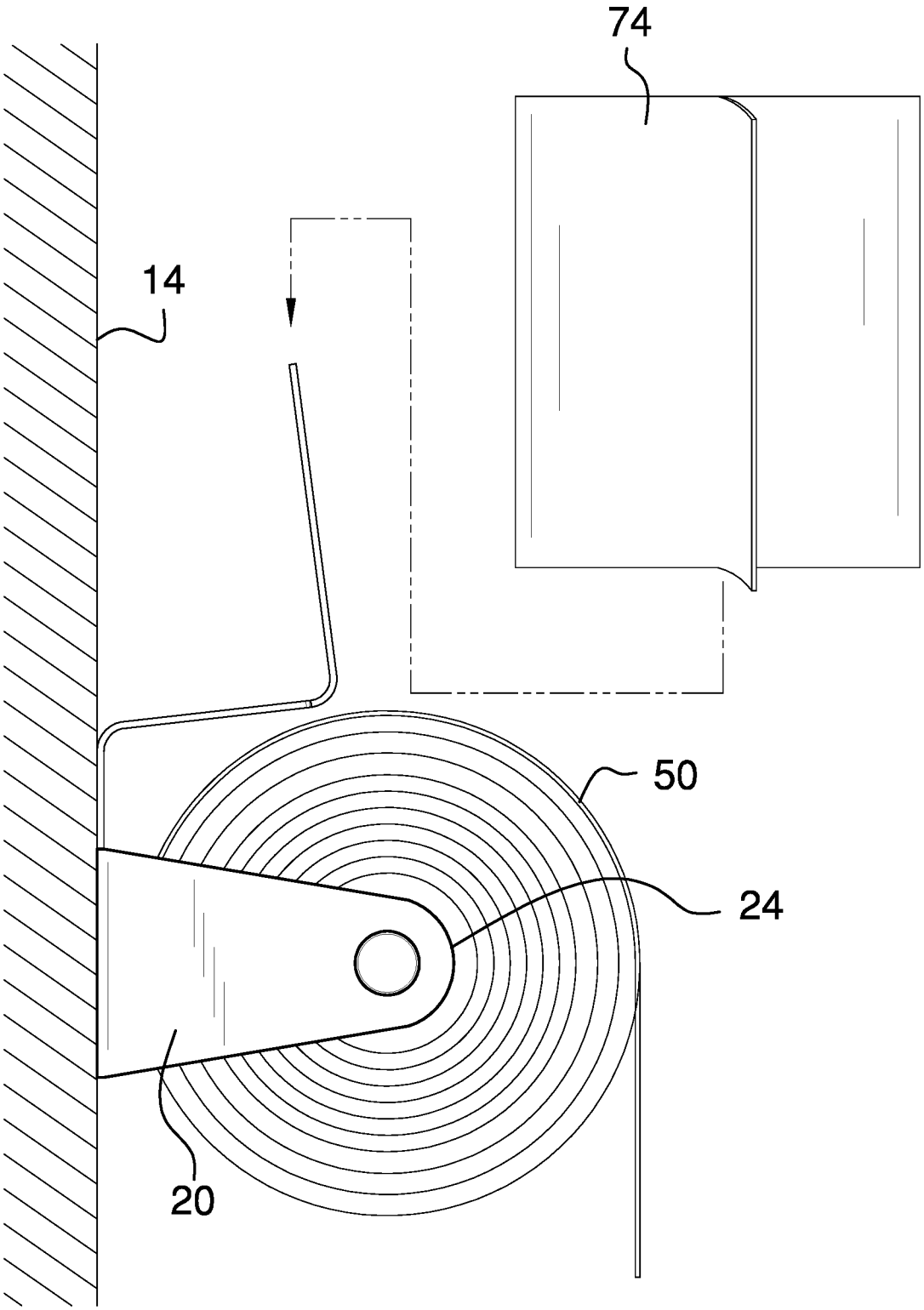
FIG. 4 is a perspective in-use view of an embodiment of the disclosure.
Figure 5:
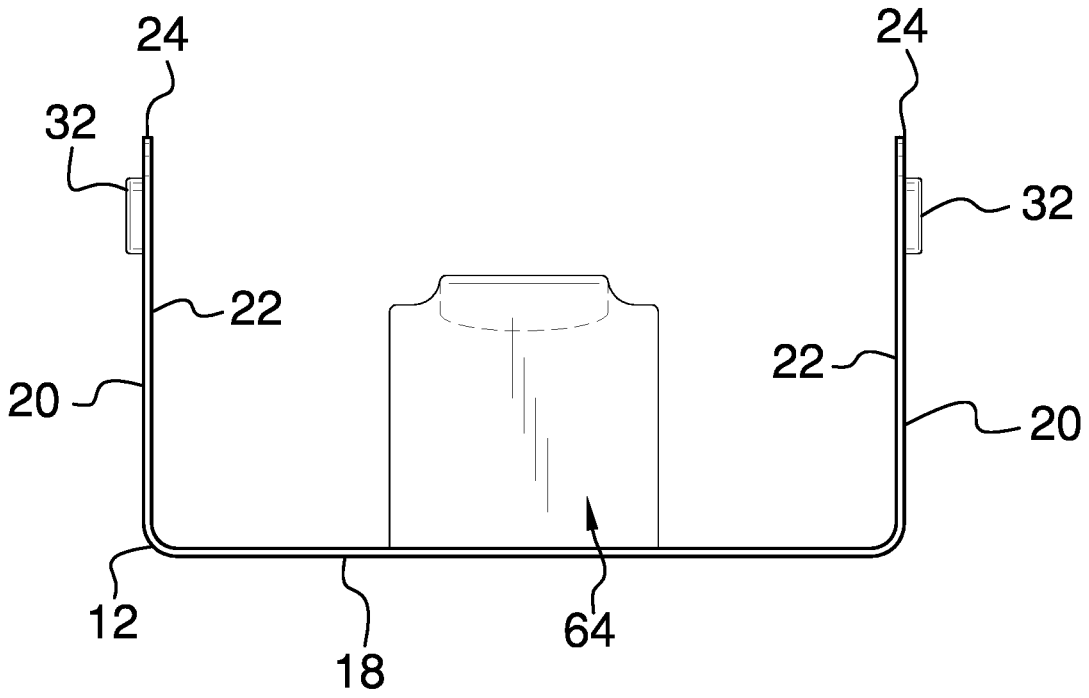
FIG. 5 is a bottom view of an embodiment of the disclosure.
Figure 6:
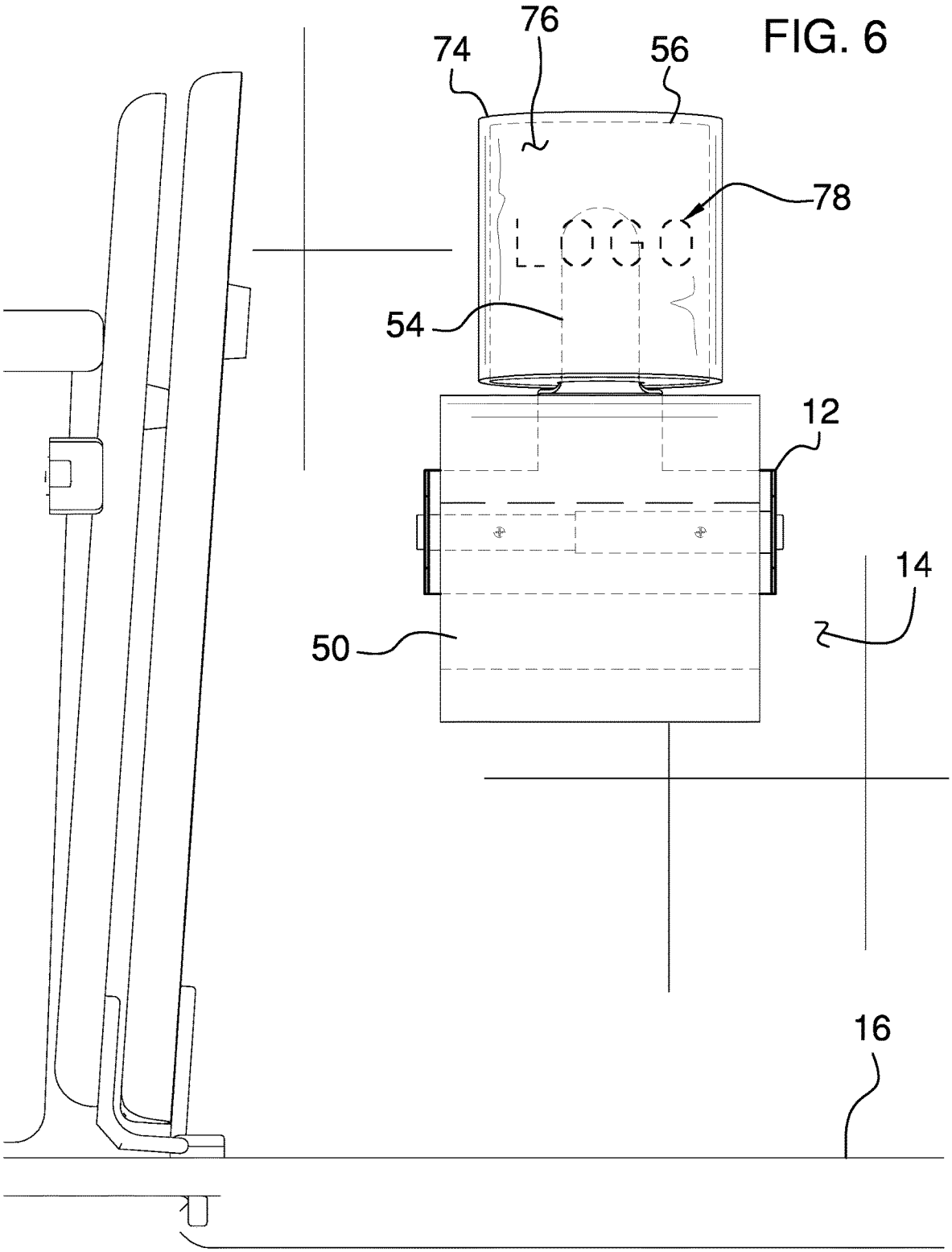
FIG. 6 is a front phantom in-use view of an embodiment of the disclosure.

With reference now to the drawings, and in particular to FIGS. 1 through 6 thereof, a new holder device embodying the principles and concepts of an embodiment of the disclosure and generally designated by the reference numeral 10 will be described.

As best illustrated in FIGS. 1 through 6, the bathroom tissue holder assembly 10 generally comprises a bracket 12 that is mountable to a vertical support surface 14 at a point that is located proximate a lavatory 16. In this way the bracket 12 is accessible to a user of the lavatory 16. The bracket 12 has a central portion 18 extending between a pair of outward portions 20, and the outward portions 20 are spaced apart from each other and are perpendicularly oriented with respect to the central portion 18 such that the bracket 12 has a U-shape. Each of the outward portions 20 has an inwardly facing surface 22 that is directed toward each other and a distal end 24 with respect to the central portion 18. The central portion 18 has a top edge 26, a rear surface 28 and a front surface 30.

Each of the outward portions 20 has a receiver 32 that is recessed into the inwardly facing surface 22. The receiver 32 on each of the outward portions 20 is positioned adjacent to the distal end 24 of the outward portions 20. The receiver 32 in each of the outward portions 20 has a bounding surface 34 and the bounding surface 34 of the receiver 32 in each of the outward portions 20 is continuously arcuate such that the receiver 32 in each of the outward portions 20 has a circular shape. The receiver 32 in each of the outward portions 20 extends outwardly beyond an outwardly facing surface 35 of the outward portions 20. The central portion 18 has a pair of holes 36 each extending through the central portion 18 to accommodate a fastener 38 to engage the vertical support surface 14. Additionally, each of the holes 36 is positioned proximate a respective one of the outward portions 20. Each of the holes 36 has a bounding surface 40 and the bounding surface 40 of each of the holes 36 is chamfered with respect to the front surface 30 of the central portion 18.

A shaft 44 is included which has a first portion 46 that slidably engages a second portion 48 such that the shaft 44 has a telescopically adjustable length. The shaft 44 removably engages the bracket 12 to support a first roll of toilet tissue 50 on the bracket 12. The shaft 44 has a first end 51 and a second end 52, and each of the first end 51 and the second end 52 is inserted into the receiver 32 in a respective one of the outward portions 20. The shaft 44 is biased into an extended position having the first end 51 being directed away from the second end 52 for retaining the shaft 44 in the receiver 32 in each of the outward portions 20. The shaft 44 is collapsible having the first end 51 being urged toward the second end 52 for removing the shaft 44 from the receiver 32 in each of the outward portions 20.

A holder 54 is coupled to and extends upwardly from the bracket 12 to support a second roll of toilet tissue 56 thereby facilitating the second roll of toilet tissue 56 to be accessible when the first roll of toilet tissue 50 is depleted. In this way the user can employ the second roll of toilet tissue 56 in the event that the first roll of toilet tissue 50 is depleted before the user finishes cleaning themselves while employing the lavatory 16. The holder 54 has a coupled end 58 and a free end 60, and the holder 54 has a series of bends 62 that are integrated into the holder 54. The series of bends 62 are spaced apart from each other and are distributed between the coupled end 58 and the free end 60. The series of bends 62 defines a medial portion 64 lying on a plane that is perpendicularly oriented with each of a lower portion 66 and an upper portion 68.

The coupled end 58 is associated with the lower portion 66, the free end 60 is associated with the upper portion 68 and the free end 60 is rounded. The coupled end 58 is coupled to the top edge 26 of the central portion 18 of the bracket 12 having each of the upper portion 68 and the lower portion 66 lying on a vertical plane and has the medial portion 64 lying on a horizontal plane. In this way the upper portion 68 extends through the second roll of toilet tissue 56 having the second roll of toilet tissue 56 lying on the medial portion 64. The holder 54 has a first lateral edge 70 and a second lateral edge 72. Each of the first lateral edge 70 and the second lateral edge 72 curves inwardly toward each other at an intersection between the medial portion 64 and the upper portion 68. Thus, the upper portion 68 has a width that is less than a width of each of the medial portion 64 and the lower portion 66. Furthermore, the upper portion 68 extends along an axis that is oriented perpendicular to an axis extending between the first end 51 and the second end 52 of the shaft 44 when the shaft 44 is positioned in the receiver 32 in each of the outward portions 20 of the bracket 12.

A wrapping 74 is provided and the wrapping 74 is formable into a cylinder. In this way the wrapping 74 can be wrapped around the second roll of toilet tissue 56 when the second roll of toilet tissue 56 is being stored on the holder 54. In this way the wrapping 74 enhances conceals the appearance of the second roll of toilet tissue 56. The wrapping 74 has an exposed surface 76 which is exposed when the wrapping 74 is wrapped around the second roll of toilet tissue 56. Furthermore, the exposed surface 76 has indicia 78 printed thereon to enhance the ornamental appearance of the second roll of toilet tissue 56. The indicia 78 may comprise a logo, an image or any other ornamental indicia.

In use, the bracket 12 is mounted to the vertical support surface 14 at a location that is easily accessible to the user when the user employs the lavatory 16. The shaft 44 is extended through the first roll of toilet tissue 50 and the shaft 44 is engaged in the receiver 32 in each of the outward portions 20 of the bracket 12. In this way the user can employ the first roll of toilet tissue 50 when the user employs the lavatory 16. The wrapping 74 is wrapped around the second roll of toilet tissue 56 and the second roll of toilet tissue 56 the upper portion 68 of the holder 54 is extended through the second roll of toilet tissue 56 having the second roll of toilet tissue 56 lying on the medial portion 64 of the holder 54. In this way the second roll of toilet tissue 56 is immediately accessible to the user in the event that the first roll of toilet tissue 50 is depleted while the user is employing the lavatory 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bathroom tissue holder assembly for holding a pair of rolls of bathroom tissue, said assembly comprising:

a bracket being mountable to a vertical support surface at a point being located proximate a lavatory wherein said bracket is configured to be accessible to a user of the lavatory;

a shaft having a first portion slidably engaging a second portion such that said shaft has a telescopically adjustable length, said shaft removably engaging said bracket wherein said shaft is configured to support a first roll of toilet tissue on said bracket;

a holder being coupled to and extending upwardly from said bracket wherein said holder is configured to support a second roll of toilet tissue thereby facilitating the second roll of toilet tissue to be accessible when the first roll of toilet tissue is depleted; and a wrapping being formable into a cylinder wherein said wrapping is configured to be wrapped around the second roll of toilet tissue when the second roll of toilet tissue is being stored on said holder.

2. The assembly according to claim 1, wherein said wrapping has an exposed surface wherein said exposed surface is configured to be exposed when said wrapping is wrapped around the second roll of toilet tissue, said exposed surface having indicia being printed thereon wherein said indicia is configured to enhance the ornamental appearance of the second roll of toilet tissue.

3. The assembly according to claim 1, wherein:

said bracket has a central portion extending between a pair of outward portions, said outward portions being spaced apart from each other and being perpendicularly oriented with respect to said central portion such that said bracket has a U-shape, each of said outward portions having an inwardly facing surface being directed toward each other and a distal end with respect to said central portion, said central portion having a top edge, said central portion having a rear surface;

said central portion having a pair of holes each extending through said central portion wherein each of said holes is configured to accommodate a fastener to engage the vertical support surface, each of said holes being positioned proximate a respective one of said outward portions; and each of said outward portions has a receiver being recessed into said inwardly facing surface, said receiver on each of said outward portions being positioned adjacent to said distal end of said outward portions, said receiver in each of said outward portions having a bounding surface, said bounding surface of said receiver in each of said outward portions being continuously arcuate such that said receiver in each of said outward portions has a circular shape.

4. The assembly according to claim 3, wherein said shaft has a first end and a second end, each of said first end and said second end being inserted into said receiver in a respective one of said outward portions, said shaft being biased into an extended position having said first end being directed away from said second end for retaining said shaft in said receiver in each of said outward portions, said shaft being collapsible having said first end being urged toward said second end for removing said shaft from said receiver in each of said outward portions.

5. The assembly according to claim 1, wherein said holder has a coupled end and a free end, said holder having a series of bends being integrated into said holder, said series of bends being spaced apart from each other and being distributed between said coupled end and said free end, said series of bends defining a medial portion lying on a plane being perpendicularly oriented with each of a lower portion and an upper portion, said coupled end being associated with said lower portion, said free end being associated with said upper portion.

6. The assembly according to claim 5, wherein:

said bracket has a central portion, said central portion having a top edge; and said coupled end is coupled to said top edge of said central portion of said bracket having each of said upper portion and said lower portion lying on a vertical plane and having said medial portion lying on a horizontal plane wherein said upper portion is configured to extend through the second roll of toilet tissue having the second roll of toilet tissue lying on said medial portion.

7. The assembly according to claim 5, wherein said holder has a first lateral edge and a second lateral edge, each of said first lateral edge and said second lateral edge curving inwardly toward each other at an intersection between said medial portion and said upper portion such that said upper portion has a width being less than a width of each of said medial portion and said lower portion, said free end being rounded.

8. A bathroom tissue holder assembly for holding a pair of rolls of bathroom tissue, said assembly comprising:

a bracket being mountable to a vertical support surface at a point being located proximate a lavatory wherein said bracket is configured to be accessible to a user of the lavatory, said bracket having a central portion extending between a pair of outward portions, said outward portions being spaced apart from each other and being perpendicularly oriented with respect to said central portion such that said bracket has a U-shape, each of said outward portions having an inwardly facing surface being directed toward each other and a distal end with respect to said central portion, said central portion having a top edge, said central portion having a rear surface, each of said outward portions having a receiver being recessed into said inwardly facing surface, said receiver on each of said outward portions being positioned adjacent to said distal end of said outward portions, said receiver in each of said outward portions having a bounding surface, said bounding surface of said receiver in each of said outward portions being continuously arcuate such that said receiver in each of said outward portions has a circular shape, said central portion having a pair of holes each extending through said central portion wherein each of said holes is configured to accommodate a fastener to engage the vertical support surface, each of said holes being positioned proximate a respective one of said outward portions;

a shaft having a first portion slidably engaging a second portion such that said shaft has a telescopically adjustable length, said shaft removably engaging said bracket wherein said shaft is configured to support a first roll of toilet tissue on said bracket, said shaft having a first end and a second end, each of said first end and said second end being inserted into said receiver in a respective one of said outward portions, said shaft being biased into an extended position having said first end being directed away from said second end for retaining said shaft in said receiver in each of said outward portions, said shaft being collapsible having said first end being urged toward said second end for removing said shaft from said receiver in each of said outward portions;

a holder being coupled to and extending upwardly from said bracket wherein said holder is configured to support a second roll of toilet tissue thereby facilitating the second roll of toilet tissue to be accessible when the first roll of toilet tissue is depleted, said holder having a coupled end and a free end, said holder having a series of bends being integrated into said holder, said series of bends being spaced apart from each other and being distributed between said coupled end and said free end, said series of bends defining a medial portion lying on a plane being perpendicularly oriented with each of a lower portion and an upper portion, said coupled end being associated with said lower portion, said free end being associated with said upper portion, said coupled end being coupled to said top edge of said central portion of said bracket having each of said upper portion and said lower portion lying on a vertical plane and having said medial portion lying on a horizontal plane wherein said upper portion is configured to extend through the second roll of toilet tissue having the second roll of toilet tissue lying on said medial portion, said holder having a first lateral edge and a second lateral edge, each of said first lateral edge and said second lateral edge curving inwardly toward each other at an intersection between said medial portion and said upper portion such that said upper portion has a width being less than a width of each of said medial portion and said lower portion, said free end being rounded; and a wrapping being formable into a cylinder wherein said wrapping is configured to be wrapped around the second roll of toilet tissue when the second roll of toilet tissue is being stored on said holder, said wrapping having an exposed surface wherein said exposed surface is configured to be exposed when said wrapping is wrapped around the second roll of toilet tissue, said exposed surface having indicia being printed thereon wherein said indicia is configured to enhance the ornamental appearance of the second roll of toilet tissue.

* * * * *